US005577677A

United States Patent [19]

Frings et al.

[11] Patent Number: 5,577,677

[45] Date of Patent: Nov. 26, 1996

[54] AXIALLY-COMPRESSIBLE COIL CARRIER

[75] Inventors: Hermann J. Frings, Alsdorf; Franz J. Hallmann, Würselen; Albert Keusch, Übach-Palenberg, all of Germany

[73] Assignee: Technimark, Inc., Asheboro, N.C.

[21] Appl. No.: 395,563

[22] Filed: Feb. 28, 1995

[51] Int. Cl.[6] ..... B65H 75/20; D06F 17/00

[52] U.S. Cl. ..... 242/118.11; 68/198

[58] Field of Search ..... 242/118.11, 118.1, 242/604; 68/198, 189

[56] References Cited

U.S. PATENT DOCUMENTS

| | | | |
|---|---|---|---|
| 4,702,433 | 10/1987 | Gilljam et al. . | |
| 4,789,111 | 12/1988 | Thomas et al. | 242/118.11 X |
| 4,872,621 | 10/1989 | Thomas | 242/118.11 |
| 5,094,404 | 3/1992 | DesRosiers et al. | 242/118.11 |
| 5,131,595 | 7/1992 | Romagnoli | 242/118.1 |
| 5,169,087 | 12/1992 | Romagnoli | 242/118.1 |
| 5,445,335 | 8/1995 | Hallmann et al. | 242/118.11 X |

FOREIGN PATENT DOCUMENTS

| | | | |
|---|---|---|---|
| 0233365B1 | 3/1992 | European Pat. Off. . | |
| 2659309 | 9/1991 | France | 242/118.11 |
| 4219844A1 | 1/1994 | Germany . | |
| 1169962 | 11/1969 | United Kingdom | 242/118.11 |

*Primary Examiner*—Michael R. Mansen
*Attorney, Agent, or Firm*—Popham, Haik, Schnobrich & Kaufman, Ltd.

[57] ABSTRACT

An axially-compressible coil carrier comprising first and second parallel, coaxial end rings, a plurality of carrier rings positioned between the first and second end rings, and a plurality of support struts arranged in rings, the rings of struts alternating with the carrier rings, and neighboring carrier rings being joined to each other by one of the rings of support struts. The carrier rings are parallel to and coaxial with each other and with the first and second end rings, and are separated by an inside distance of between about 5 mm and about 12 mm. The struts in each of the rings are divided into first and second groups. The struts in the first group are spaced equidistantly around the circumference, and are alternated with pairs of struts of the second group. The struts of the second group are generally parallel to their neighboring struts of the first group to form triads of parallel struts, the struts in each the triad being equidistantly spaced. The junctions of the outer surfaces and the side faces of the struts of the first group are uniformly inclined at an angle α of between about 11° to about 30° to a line on the outer cylindrical surface parallel to the longitudinal axis of the coil carrier. The side faces of the struts of the first group are uniformly inclined at an angle β of between about 1° and about 10° to respective radii of the coil carrier. The struts on opposite sides of a carrier ring have opposite inclinations. Preferably, each of the struts has in the outer cylindrical surface a width between the side faces of between about 0.7 mm and about 3.0 mm; and each of the struts has an average extent between the inner and outer faces of about 4 mm to about 8 mm; and the number of struts in each the ring of struts is between 12 and 24.

21 Claims, 2 Drawing Sheets

AXIALLY-COMPRESSIBLE COIL CARRIER

BACKGROUND OF THE INVENTION

1. Field of the Invention

The present invention relates to axially-compressible coil carriers for use in yarn winding machines. More specifically, the invention relates to such coil carriers which are dimensioned to resist elongation when wound with yarn.

2. Related Art

Coil carriers having two end rings with a shell therebetween are well known. In an axially-compressible coil carrier, the shell typically is built of a number of coaxial carrier rings with neighboring rings being fixed to each other by inclined struts. Examples of such coil carriers are disclosed in U.S. Pat. No. 4,702,433; German Offenlegungsschrift 42 19 844; and Europäische Patentschrift 0 233 365; as well as co-pending U.S. patent application Ser. No. 08/078,982, now U.S. Pat. No. 5445,335, which is incorporated herein by reference in its entirety.

Coil carriers can be provided with end rings at each end which thrust together or interlock. In the case of interlocking end rings, the outer diameter of the interlocking collar of one end ring can be matched with the inner diameter of the receiver of the other end ring so as to enable a thread reserve to be accommodated on the collar. For this purpose, a thread reserve groove can also be installed on the collar, as described in U.S. Pat. No. 4,702,433.

Coil carriers of the type described above are wound with yarn, and can then be subjected to a heat or wet treatment, for example a dye bath in which the yarn is dyed by the bath passing through the coil carrier. The yarn is loaded or wound onto the coil carrier by an automatic winding machine. After it has been loaded with yarn, the coil carrier is automatically released by the winding machine. For technical reasons the tolerances of modern winding machines as to the length of the coil carriers are very narrow. In fact, it has been found that winding yarn onto an axially-compressible coil carrier leads to elongation of the coil carrier. Due to this elongation, the loaded coil carrier actually may become clamped in its position in the winding machine, preventing it from being automatically released for further processing. This problem has not been recognized, much less addressed or solved by the prior art. It is to the solution of this problem that the present invention is addressed.

SUMMARY OF THE INVENTION

It is therefore a primary object of the present invention to provide an axially-compressible coil carrier which is resistant to elongation upon loading.

This and other objects are achieved by the provision of an axially-compressible coil carrier comprising first and second parallel, coaxial end rings, a plurality of carrier rings positioned between the first and second end rings, and a plurality of support struts arranged in rings, the rings of struts alternating with the carrier rings, neighboring carrier rings being joined to each other by one of the rings of support struts.

The carrier rings are parallel to and coaxial with each other and with the first and second end rings. The inner surfaces of the carrier rings are co-cylindrical with each other, and the outer surfaces of the carrier rings are co-cylindrical with each other.

The inner surfaces of the struts are co-cylindrical with each other and with the carrier ring inner surfaces to define the inner cylindrical surface of the carrier ring. Likewise, the outer surfaces of the struts are co-cylindrical with each other and with the carrier ring outer surfaces to define the outer cylindrical surface of the carrier ring.

The struts in each of the rings are divided into a first group of struts and a second group of struts. The struts in the first group are provided with elements which interact with limiting stops on facing surfaces of the carrier rings, to limit displacement of the struts during axial compression of the coil carrier. The struts in the first group are spaced equidistantly around the circumference.

The struts of the first group are alternated with pairs of struts of the second group. The struts of the second group are generally parallel to their neighboring struts of the first group to form triads of parallel struts, the struts in each the triad being equidistantly spaced.

The junctions of the outer surfaces and the side faces of the struts of the first group are uniformly inclined at an angle $\alpha$ to a line on the inner cylindrical surface or the outer cylindrical surface parallel to the longitudinal axis of the coil carrier. The side faces of the struts of the first group are uniformly inclined at an angle $\beta$ to respective radii of the coil carrier. The struts on opposite sides of a carrier ring have opposite inclinations.

In order to achieve the objects of the invention, the dimensions of the coil carrier are within certain parameters. In a preferred embodiment, the angle $\alpha$ is between about 11° to about 30°; the angle $\beta$ is between about 1° and about 10°; neighboring carrier rings preferably are separated by an inside distance between facing first and second faces of between about 5 mm and about 12 mm; the fillets between each carrier ring and its adjacent struts have a radius of curvature of up to about 5 mm; each of the struts has in the outer cylindrical surface a width between the side faces of between about 0.7 mm and about 3.0 mm; and each of the struts has an average extent between the inner and outer faces of about 4 mm to about 8 mm; and the number of struts in each the ring of struts is between 12 and 24. More particularly, the angle 60 is between about 20° and about 25°; and preferably the angle $\alpha$ is about 22.5°; the angle $\beta$ is about 3°; neighboring carrier rings are separated by an inside distance of about 9.3 mm; the fillets have a radius of curvature of about 2.5 mm; each of the struts has in the outer cylindrical surface a width between the side faces of about 1.2 mm; and each of the struts has an average extent between the inner and outer faces of about 5.04 mm; and the number of struts in each the ring of struts is 18.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
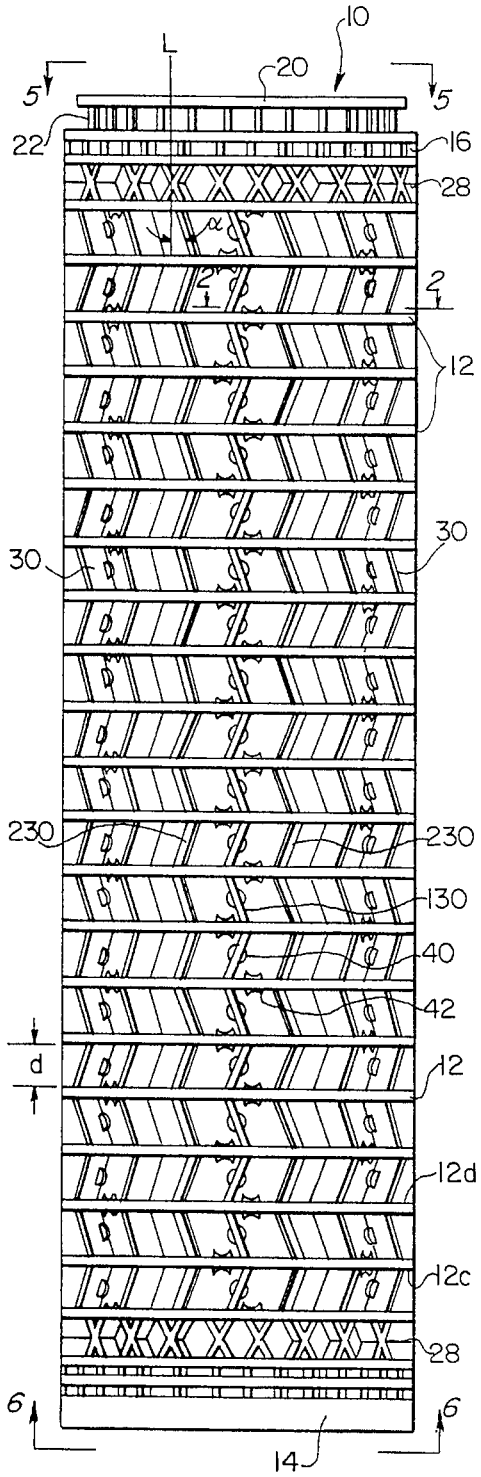
FIG. 1 is a side elevational view of the coil carrier in accordance with the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 5:
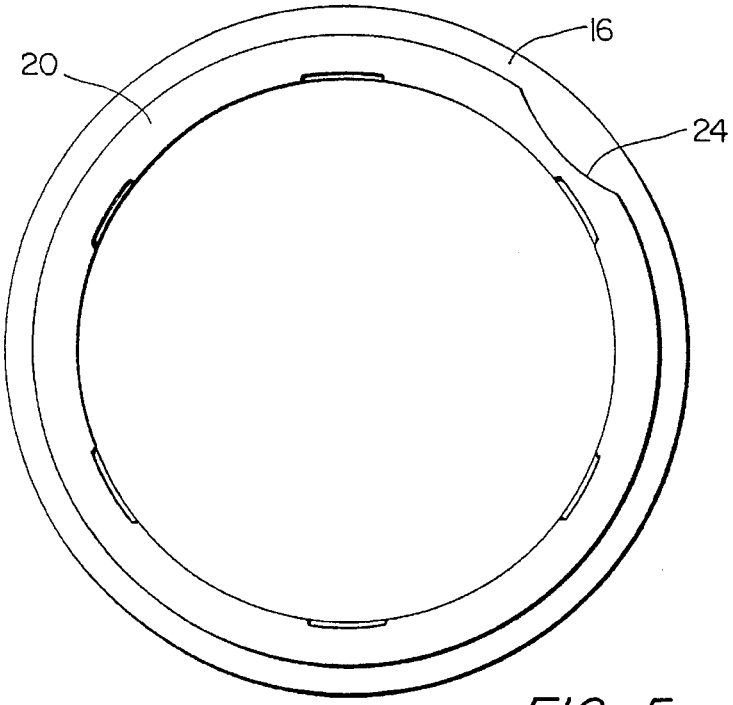
FIG. 5 is a cross-sectional view taken along line 5—5 of FIG. 1.
Figure 6:
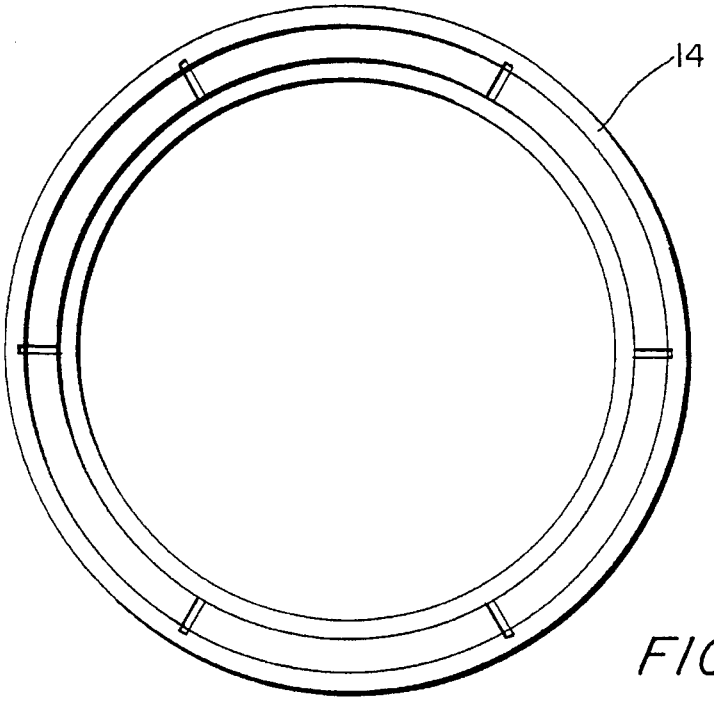
FIG. 6 is a cross-sectional view taken along line 6—6 of FIG. 1.

Referring now to FIG. 1, there is shown an axially-compressible coil carrier 10 in accordance with the present invention. Coil carrier 10 has parallel coaxial carrier rings 12, and first and second end rings 14, 16. Second end ring 16 has a collar 20, with an annular thread reserve groove 22 and a circumferential depression 24 (shown in FIG. 5). The collar 20 fits into a receiver 26 on the first end ring 14 of a neighboring, identical coil carrier employed in the heat or wet treatment process, and the thread reserve groove 22 functions to accommodate a thread reserve from which a thread can be fed, as described in U.S. Pat. No. 4,702,433. The circumferential depression 24 allows for the passage of yarn into the thread reserve groove 22.

The first and second end rings 14, 16 are each joined to the nearest carrier ring 12 via first and second outer rings of axial support struts 28. Support struts 28 are shown in FIG. 1 as X-shaped to provide a rigid (i.e., non-compressible) linkage between the end rings 14, 16 and their nearest carrier rings 12. Because they are open, support struts 28 provide a passage for liquid from the inside to the outside of the coil carrier 10. Although they are shown in FIG. 1 as X-shaped, other configurations of support struts 28 are possible, as long as they provide the necessary rigidity and passage for liquid.

Figure 2:
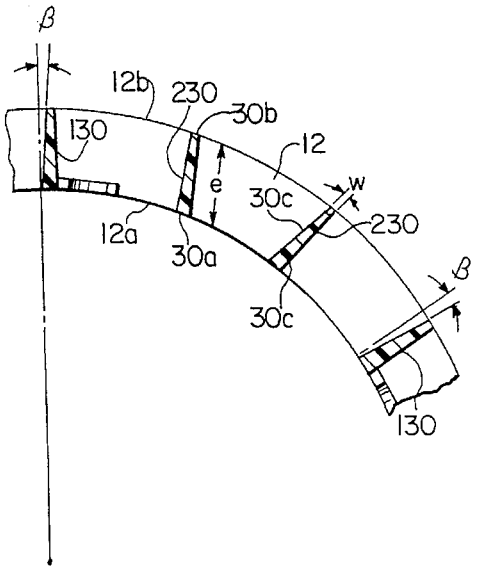
FIG. 2 is an enlarged, fragmentary cross-sectional view taken along line 2—2 of FIG. 1.

The carrier rings 12 are joined to each other by inner rings of axial support struts 30. As best seen in FIG. 2, the carrier rings 12 and the struts 30 have respective inner surfaces 12*a* and 30*a* which are co-cylindrical (i.e., they lie on the same inner cylindrical surface, which defines the inner cylindrical surface of the coil carrier 10) and respective outer surfaces 12*b* and 30*b* which are co-cylindrical (i.e., they lie on the same outer cylindrical surface, which defines the outer cylindrical surface of the coil carrier 10).

The carrier rings 12 are spaced equidistantly between first and second end rings 14, 16. Carrier rings 12 have opposed first and second faces 12*c* and 12*d* (best seen in FIG. 4), first faces facing first end ring 14 and second faces facing second end ring 16. The struts 30 have opposed side faces 30*c* (best seen in FIG. 2) which extend between the inner and outer surfaces of the struts 30. The inner surfaces 30*a* of the struts 30 are slightly wider than their outer surfaces 30*b*, so that side faces 30*c* are not quite parallel.

All of the struts 30 are configured with the junction of their outer surfaces 30*b* and their side faces 30*c* at an angle α (shown in FIG. 3) to a surface line L running parallel to the axis of the coil carrier 10 in such a manner that the inclination of the struts 30 on one side of a carrier ring 12 is an exact reflection of the inclination of the struts 30 on the other side of the same carrier ring 12. Thus, adjacent rings of the struts 30, i.e., the struts 30 on the respective sides of each carrier ring 12, are inclined in opposite directions.

Referring to FIGS. 1 and 2, the struts 30 in each ring of struts are divided into two groups, those designated herein as 130, which are provided on their inner surfaces 30*a* with discoid intermediate elements 40, and those designated herein as 230, which are not provided with discoid intermediate elements. The struts 130 which are provided with intermediate elements 40 are configured with their side faces 30*c* uniformly inclined at an angle β (shown in FIG. 2) to respective radii R of the coil carrier 10. Also, they are spaced circumferentially so as to be arranged in diametrically opposite pairs.

Figure 3:
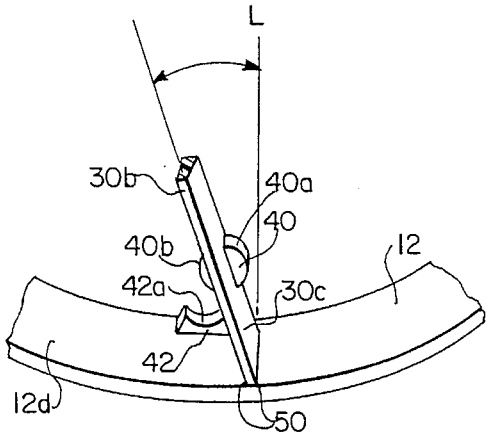
FIG. 3 is an enlarged, fragmentary perspective view of a strut and carrier ring of the coil carrier of FIG. 1.

The intermediate elements 40 on struts 130 have cylindrical circumferences, and are substantially centered with respect to the inner surfaces 30*a* of the struts 130 so as to have two functional surfaces 40*a*, 40*b*, one on each side of a strut 130, as is shown particularly clearly in FIG. 3. On the facing surfaces of neighboring carrier rings 12, there are identical limiting stops 42. Limiting stops 42 are substantially centered with respect to the inner surfaces of the carrier rings 12 so as to have two concave faces 42*a*, 42*b*, one on each side of a carrier ring 12.

Figure 4:
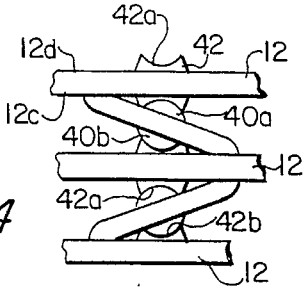
FIG. 4 is an enlarged, fragmentary view of three carrier rings and their intermediate struts in a compressed condition.

When the coil carrier is subjected to axial compression, the struts 30 are deformed as shown in FIG. 4. As a result of this compression, the intermediate elements 40 are also displaced, until the functional surfaces 40*a* of the intermediate elements 40 finally interlock with the faces 42*a* of the limiting stops 20, and the functional surfaces 40*b* interlock with the faces 42*b*, and prevent any further compression. The interacting surfaces are oriented normal to the axis of the coil carrier 10, as a result of which no radially outward or radially inward inclination occurs, which means that no radial force components can be diverted from the compressive force.

The struts 30 which are provided with intermediate elements 40 are alternated with pairs of the struts 230 which do not have intermediate elements 40. The struts 230 which do not have intermediate elements 40 are generally parallel to their neighboring struts 130 which are provided with intermediate elements 40. Thus, triads of parallel struts 30 are formed. The struts 30 in each triad are equidistantly spaced.

We have found that by the proper dimensioning and configuration of the carrier rings 12 and the struts 30, elongation resulting from winding can be greatly reduced or eliminated. For example, the angle α preferably is in the range of about 11° to about 30°, more particularly in the range of about 20° to about 25°. The angle β preferably is in the range of about 1° to about 10°. In addition, the connecting radius of curvature ρ of the fillet 50 between each carrier ring 12 and its adjacent struts 30 preferably is in the range of 0 mm to about 5 mm. The width w of each of the struts 30 between its side faces 30*c* in the outer cylindrical surface preferably is about 0.7 to about 3.0 mm. The average extent e of the struts 30 in the radial direction, i.e., between its inner and outer faces 30*a* and 30*b*, preferably is about 4 mm to about 8 mm. The inside distance d between neighboring carrier rings 12, i.e. the distance between the first face 12*c* of one carrier ring 12 and the facing second face 12*d* of its neighboring carrier ring 12, preferably is between about 5 mm and 12 mm. The number of struts 30 in each ring of struts preferably is between 12 and 24. In a working model constructed to test the dimensioning and configuration of the carrier rings 12 and the struts 30, the angle α was about 22.5°, the angle β was about 3°, the connecting radius of curvature ρ was about 2.5 mm, the width w of the struts 30 was about 1.2 mm, the extent e of the struts 30 was about 5.04 mm, the inside distance d between neighboring carrier rings was about 9.3 mm, and the number of struts 30 in each ring of struts was 18.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. An axially-compressible coil carrier having a circumference, a longitudinal axis, and inner and outer cylindrical surfaces, and comprising:

first and second parallel, coaxial end rings;

a plurality of carrier rings positioned between said first and second end rings, said carrier rings being parallel to and coaxial with each other and with said first and second end rings, each of said carrier rings having carrier ring inner and outer surfaces and opposed first and second faces, said inner surfaces being co-cylindrical with each other, said outer surfaces being co-cylindrical with each other, and said first faces facing said first end ring and said second faces facing said second end ring; and a plurality of support struts arranged in rings, said rings of struts alternating with said carrier rings so that said struts of each of said rings of struts are adjacent at least one of said carrier rings, neighboring carrier rings being joined to each other by one of said rings of support struts, and there being the same number of struts in each of said rings of struts, said struts in each of said rings being divided into a first group of struts and a second group of struts, said struts in said first group being spaced equidistantly around said circumference, all of said struts having strut inner and outer surfaces and opposed side faces, said strut inner surfaces being co-cylindrical with each other and with said carrier ring inner surfaces to define said inner cylindrical surface, said strut outer surfaces being co-cylindrical with each other and with said carrier ring outer surfaces to define said outer cylindrical surface, the junctions of said outer surfaces and said side faces of said struts of said first group being uniformly inclined at an angle $\alpha$ to a line on said outer cylindrical surface parallel to said longitudinal axis of said coil carrier, said angle $\alpha$ being between about 11° to about 30°, said side faces of said struts of said first group being uniformly inclined at an angle $\beta$ to respective radii of said coil carrier, said angle $\beta$ being between about 1° and about 10°, and said struts on opposite sides of a carrier ring having opposite inclinations.

2. The coil carrier of claim 1, wherein said struts of said first group are alternated with pairs of struts of said second group with each said strut of said first group having a neighboring strut of said second group adjacent each of its side faces to form triads of struts, said side faces of said struts of said second group in each triad being approximately parallel to corresponding side faces of their neighboring strut of said first group, said struts in each said triad being equidistantly spaced.

3. The coil carrier of claim 1, wherein said angle $\alpha$ is between about 20° and about 25°.

4. The coil carrier of claim 3, wherein said angle $\alpha$ is about 22.5° and said angle $\beta$ is about 3°.

5. The coil carrier of claim 1, wherein neighboring carrier rings are separated by an inside distance between facing first and second faces of between about 5 mm and about 12 mm.

6. The coil carrier of claim 5, wherein neighboring carrier rings are separated by an inside distance of about 9.3 mm.

7. The coil carrier of claim 1, further comprising fillets between each said carrier ring and its adjacent struts, and wherein said fillets have a radius of curvature of greater than zero and up to about 5 mm.

8. The coil carrier of claim 7, wherein said fillets have a radius of curvature of about 2.5 mm.

9. The coil carrier of claim 1, wherein each of said struts has in said outer cylindrical surface a width between said side faces of between about 0.7 mm and about 3.0 mm, and wherein each of said struts has an average extent between said inner and outer surfaces of about 4 mm to about 8 mm.

10. The coil carrier of claim 9, wherein each of said struts has in said outer cylindrical surface a width between said side faces of about 1.2 mm, and wherein each of said struts has an average extent between said inner and outer faces of about 5.04 mm.

11. The coil carrier of claim 1, wherein the number of struts in each said ring of struts is between 12 and 24.

12. The coil carrier of claim 11, wherein the number of struts in each said ring of struts is 18.

13. An axially-compressible coil carrier having a circumference, a longitudinal axis, and inner and outer cylindrical surfaces, and comprising:

first and second parallel, coaxial end rings;

a plurality of carrier rings positioned between said first and second end rings, said carrier rings being parallel to and coaxial with each other and with said first and second end rings, each of said carrier rings having carrier ring inner and outer surfaces and opposed first and second faces, said inner surfaces being co-cylindrical with each other, said outer surfaces being co-cylindrical with each other, and said first faces facing said first end ring and said second faces facing said second end ring, and neighboring carrier rings being separated by an inside distance between facing first and second faces of between about 5 mm and about 12 mm;

a plurality of support struts arranged in rings, said rings of struts alternating with said carrier rings so that said struts of each of said rings of struts are adjacent at least one of said carrier rings, neighboring carrier rings being joined to each other by one of said rings of support struts, and there being the same number of struts in each of said rings of struts, said struts in each of said rings being divided into a first group of struts and a second group of struts, said struts in said first group being spaced equidistantly around said circumference, all of said struts having strut inner and outer surfaces and opposed side faces, said strut inner surfaces being co-cylindrical with each other and with said carrier ring inner surfaces to define said inner cylindrical surface, said strut outer surfaces being co-cylindrical with each other and with said carrier ring outer surfaces to define said outer cylindrical surface, the junctions of said outer surfaces and said side faces of said struts of said first group being uniformly inclined at an angle $\alpha$ to a line on said outer cylindrical surface parallel to said longitudinal axis of said coil carrier, said angle $\alpha$ being between about 11° to about 30°, said side faces of said struts of said first group being uniformly inclined at an angle $\beta$ to respective radii of said coil carrier, said angle $\beta$ being between about 1 and about 10°, and said struts on opposite sides of a carrier ring having opposite inclinations, each of said struts having in said outer cylindrical surface a width between said side faces of between about 0.7 mm and about 3.0 mm, and each of said struts having an average extent between said inner and outer faces of about 4 mm to about 8 mm;

and fillets formed between each said carrier ring and its adjacent struts, and wherein said fillets have a radius of curvature of greater than zero and up to about 5 mm.

14. The coil carrier of claim 13, wherein said struts of said first group are alternated with pairs of struts of said second group with each said strut of said first group having a neighboring strut of said second group adjacent each of its side faces to form triads of struts, said side faces of said struts of said second group in each triad being approximately parallel to corresponding side faces of their neighboring strut of said first group, said struts in each said triad being equidistantly spaced.

15. The coil carrier of claim 13, wherein said angle $\alpha$ is between about 20° and 25°.

16. The coil carrier of claim 13, wherein said angle $\alpha$ is about 22.5° and said angle $\beta$ is about 3°.

17. The coil carrier of claim 13, wherein neighboring carrier rings are separated by an inside distance of about 9.3 mm.

18. The coil carrier of claim 13, wherein said fillets have a radius of curvature of about 2.5 mm.

19. The coil carrier of claim 13, wherein each of said struts has in said outer cylindrical surface a width between said side faces of about 1.2 mm, and wherein each of said struts has an average extent between said inner and outer surfaces of about 5.04 mm.

20. The coil carrier of claim 13, wherein the number of struts in each said ring of struts is between 12 and 24.

21. The coil carrier of claim 20, wherein the number of struts in each said ring of struts is 18.

* * * * *

Disclaimer 5,577,677—Hermann J. Frings, Alsdorf; Franz J. Hallmann, Wurselen; Albert Keusch, Ubach-Palenberg, all of Germany. AXIALLY-COMPRESSIBLE COIL CARRIER. Patent dated November 26, 1996. Disclaimer and Dedication filed April 15, 1998, by the assignee, Technimark Inc.

Hereby disclaims and dedicates to the Public claims 1-21.

*(Official Gazette,* July 14, 1998)